US008726534B2

(12) United States Patent
Chappell et al.

(10) Patent No.: US 8,726,534 B2
(45) Date of Patent: May 20, 2014

(54) VENTILATED PORTABLE CONTAINER FOR SPORTS EQUIPMENT

(76) Inventors: Murray Chappell, South Woodslee (CA); Roger Robinet, Windsor (CA); E. Marie Costello, Windsor (CA); Joe Frei, Harrow (CA)

( * ) Notice: Subject to any disclaimer, the term of this patent is extended or adjusted under 35 U.S.C. 154(b) by 243 days.

(21) Appl. No.: 13/014,834

(22) Filed: Jan. 27, 2011

(65) Prior Publication Data

US 2011/0197464 A1 Aug. 18, 2011

Related U.S. Application Data

(60) Provisional application No. 61/299,471, filed on Jan. 29, 2010, provisional application No. 61/417,486, filed on Nov. 29, 2010.

(51) Int. Cl.
*F26B 25/06* (2006.01)

(52) U.S. Cl.
USPC ..... 34/202; 34/232; 68/5 C; 206/315.1; 223/51

(58) Field of Classification Search
USPC ..... 34/90, 104, 105, 202, 232; 68/5 C, 68/12.26, 512; 190/107, 109, 901; 206/315.1; 135/129, 128, 135, 137; 223/51, 70, 73, 76; 219/386, 400
See application file for complete search history.

(56) References Cited

U.S. PATENT DOCUMENTS

| | | | | | |
|---|---|---|---|---|---|
| 2,975,529 | A * | 3/1961 | Weber | 34/622 |
| 3,513,564 | A * | 5/1970 | Gramprie | 34/104 |
| 3,805,561 | A * | 4/1974 | Bullock | 68/5 C |
| 5,369,892 | A * | 12/1994 | Dhaemers | 34/275 |
| 5,592,750 | A * | 1/1997 | Eichten | 34/104 |
| 5,930,915 | A * | 8/1999 | Dhaemers | 34/511 |
| 6,134,806 | A * | 10/2000 | Dhaemers | 34/404 |
| 6,263,591 | B1 * | 7/2001 | La Porte | 34/622 |
| 6,327,792 | B1 * | 12/2001 | Hebert | 34/104 |
| 6,840,068 | B2 * | 1/2005 | Pasin et al. | 68/5 C |
| 7,152,614 | B2 * | 12/2006 | Kalnay | 135/128 |
| 7,328,780 | B2 * | 2/2008 | Hawthorne | 190/107 |
| 2007/0000143 | A1 * | 1/2007 | Rosseau et al. | 34/104 |
| 2011/0197464 | A1 * | 8/2011 | Chappell et al. | 34/202 |

FOREIGN PATENT DOCUMENTS

| | | | | |
|---|---|---|---|---|
| EP | 627519 | A1 * | 12/1994 | D06F 58/10 |
| JP | 06209893 | A * | 8/1994 | A47L 23/20 |
| JP | 07260352 | A * | 10/1995 | F26B 21/10 |
| WO | WO 9629458 | A1 * | 9/1996 | D06F 58/10 |

* cited by examiner

*Primary Examiner* — Steve M Gravini
(74) *Attorney, Agent, or Firm* — Norton Rose Fulbright Canada LLP

(57) ABSTRACT

A ventilated portable container is a carrying case or sports equipment bag for storing, carrying and drying sports equipment. The portable container includes a ventilator for drawing fresh air into the container and for encouraging stale air out of the container through at least one filtered air outlet. The portable container includes an exterior pocket having at least one air inlet and at least one air vent.

21 Claims, 16 Drawing Sheets

VENTILATED PORTABLE CONTAINER FOR SPORTS EQUIPMENT

CROSS REFERENCE TO RELATED APPLICATIONS

The present disclosure claims priority from U.S. Patent Application Nos. 61/299,471 and 61/417,486, the entireties of which are hereby incorporated by reference.

FIELD OF TECHNOLOGY

The present invention generally relates to bags for sports equipment and, more particularly, to a ventilated portable container for carrying and drying sports equipment.

BACKGROUND

After a game or practice, particularly in sports such as hockey or football, sweaty sports equipment is typically packed into an equipment bag and carried home or to a hotel or motel. As is well know, if damp equipment is left in a sports bag, it not only dries slowly but foul odors will accumulate due to mold, mildew and bacteria. Although this problem is most acute in sports such as hockey and football where bulky pads and other equipment are packed tightly into a sports bag after a game and practice, this problem arises in other sports as well.

Accordingly, in order to dry equipment after a game or practice, and in order to help dissipate foul smells, damp sports equipment should be unpacked from the bag and aired out. In sports such as hockey or football, where the pads and equipment are both numerous and bulky, the unpacking and spreading out of all the pads and equipment can take quite a bit of time. Furthermore, sufficient space is needed to spread out all the equipment. Typically, sports equipment is spread out in laundry rooms, garages or basements, or placed on specially-designed equipment racks. Once unpacked, the equipment must be left for quite a long period of time to allow it to dry from mere passive aeration. Therefore, this traditional approach of unpacking and passive aeration has been considered unsatisfactory as it takes too much time and too much space and results in the undesirable emanation of foul odors in a portion of a player's dwelling.

Moreover, unpacking and passive aeration of equipment is particularly inadequate when athletes travel to tournaments and stay in cramped hotel or motel rooms, often sharing rooms with family members or other players. For traveling teams, where space and time are tight, the drying out of equipment between games can be a significant problem. Even when traveling home from a game or practice, wet equipment will tend to emanate foul odors which will impregnate the bag itself or even the player's vehicle, for example, where the journey home is long or where the player stops for a drink or food after the game.

In order to facilitate drying and airing out of sports equipment, some sports bags are provided with meshed vents to passively exchange air with the environment and thus to passively exhaust bad odors from the bag. However, passive aeration is very slow, particularly where wet pads are tightly packed in the bag. Where games or practices are closely scheduled, the equipment seldom has enough time to properly dry out, and thus players end up having to put on damp equipment, an experience which is universally regarded as unpleasant.

In recent years, some sports bag designs have attempted to address this problem by providing active ventilation coupled with air fresheners. For example, Canadian Patent Application 2,295,511 entitled Clothes Dryer Garment Bag disclosed a sports bag with an air distribution manifold in the base of the bag and an externally connected blower fan which blows air into the bag via a hose connected to an inlet mounted in the front panel of the bag. Air therefore flows from the blower through the hose, through the manifold and into the bag, thus driving stale air out of the bag through air filters. However, this apparatus appears to be unduly costly to manufacture and unnecessarily complicated to operate. The apparatus would be expensive to manufacture due to the fairly complex structure of the air distributor manifold in the base of the bag, not to mention the hose connector and the stand-alone blower. Furthermore, the separation of the blower and bag makes the apparatus a bit unwieldy to carry around because not only must the player carry the bag itself but he or she must also transport the hose and blower. Also, in operation, the apparatus occupies a large footprint since the blower and hose extend away from the bag as shown in the published patent application.

Another example of a forced-ventilation sports equipment bag is found in Canadian Patent Application 2,412,700 entitled Drying Bag for Sports Equipment and the Like. This published application discloses a sports equipment bag with a blower fan mounted in an air flow opening in one of the side walls of the bag for blowing air into the bag to drive air out the bag through a screened outlet. Since the fan is mounted in a side wall and since there is only a single outlet, the bag cannot be placed arbitrarily. Rather, the bag must be placed such that both the fan and the screened outlet are unobstructed. Therefore, the design of the bag unduly limits the orientation and location in which the bag can be set up.

These designs are therefore suboptimal for the reasons articulated above. A simpler, easier-to-use and more versatile equipment bag would therefore be highly desirable.

SUMMARY

A portable equipment container for storing, transporting and drying sports equipment, the portable equipment container comprising: a structure for holding the sports equipment, the structure being defined by at least one wall; an openable and closable closure feature having an open state, in which sports equipment can be inserted or retrieved, and a closed state, in which the feature cooperates with the structure to substantially fully enclose the sports equipment; a non-detachable ventilator mounted in a wall of the structure for drawing fresh air into the structure and for encouraging stale air from the structure to exhaust through at least one filtered air outlet located in a wall of the structure, the at least one filtered air outlet having a carbon air filter; and an exterior pocket on an exterior side of the structure, the exterior pocket having at least one air inlet and at least one filtered air vent, the at least one filtered air vent having a carbon air filter; and wherein the structure defines a volume at least 25% larger than the volume of equipment to be stored therein.

In some examples, the ventilator may be a ventilation fan.

In some examples, the ventilator may provide airflow through the structure and any equipment stored therein of about 100 to about 200 cubic feet per minute (cfm).

In some examples, the ventilator and the at least one filtered air outlet may be located in opposing ends of the structure.

In some examples, the at least one air inlet and the at least one filtered air vent of the exterior pocket may be located in opposing ends of the exterior pocket.

In some examples, the structure may define a volume 25-50% larger than the volume of equipment to be held within the structure.

In some examples, the container may be for holding hockey equipment including a pair of skates and a complete set of protective gear suitable for one hockey player, and the container may be 30%-50% larger than the volume of the equipment.

In some examples, the container may be for holding lacrosse equipment including footwear and a complete set of protective gear suitable for one lacrosse player, and the container may be 30%-50% larger than the volume of the equipment.

In some examples, the container may be for holding one pair of footwear, and the container may be 20%-25% larger than the volume of the footwear.

In some aspects, there is provided a portable equipment container for storing, carrying and drying sports equipment, the portable equipment container comprising: a structure for containing the sports equipment, the structure being defined by at least one wall; an openable and closable closure feature having an open state, in which sports equipment can be inserted or retrieved, and a closed state, in which the feature cooperates with the structure to substantially fully enclose the sports equipment; a ventilator mounted in a wall of the structure for drawing fresh air into the structure and for encouraging stale air from the structure to exhaust through at least one filtered air outlet located in a wall of the structure; and an exterior pocket on an exterior side of the structure, the exterior pocket having at least one air inlet and at least one air vent.

In some examples, the structure may be box-like having a top wall for housing the ventilator.

In some examples, the container may further comprise a pair of hanging straps extending upwards from the top wall of the structure to enable the container to be suspended, the hanging straps being disposed on either side of the ventilator.

In some examples, where there is a plurality of filtered air outlets, at least one filtered air outlet may be provided in each of: a bottom wall of the structure, in side walls of the structure and in a back wall of the structure, the filtered air outlets having filters capable of purifying the air exhausting from the structure.

In some examples, the filters may be carbon filters.

In some examples, the structure may further comprise inside mesh pockets for storing sports equipment on opposed side portions of the structure.

In some examples, the container may further comprise hooks depending from a top portion of the structure for suspending sports equipment inside the container.

In some examples, the ventilator may be detachable.

In some examples, the at least one air inlet of the exterior pocket may be in fluid communication with an interior of the structure for receiving air from inside the structure, and the at least one air vent of the exterior pocket may vent air outside of the container.

In some examples, there may be a plurality of structures, the plurality of structures being separated by partitions, wherein the partitions may include a mesh portion for fluid communication among the plurality of structures.

In some examples, the container may be detachably attachable to a carrier.

In some examples, the container may further comprise a protective shield attachable to sides of the ventilator for protecting the ventilator from debris.

In some examples, the at least one filtered air outlet may comprise a carbon filter.

In some examples, the at least one air vent of the exterior pocket may comprise an air filter for purifying air exhausted from the at least one air vent.

In some examples, the air filter may be a carbon filter.

In some examples, the container may further comprise a power cable for receiving power from a power source.

In some examples, the container may further comprise a power source.

In some aspects, there is provided a ventilated sports equipment bag for carrying and storing sports equipment, the ventilated sports bag comprising: an air inlet disposed on the bag; at least one filtered air outlet on the bag; a detachable ventilator removably connected to the air inlet for drawing air into the bag and for encouraging stale air to exhaust from the bag through the at least one filtered air outlet; and an exterior pocket on an exterior side of the bag, the exterior pocket having at least one air inlet and at least one air vent.

In some examples, the at least one air inlet of the exterior pocket may be in fluid communication with an interior of the bag for receiving air from inside the bag, and the at least one air vent of the exterior pocket may vent air outside of the bag.

In some examples, the air inlet may be disposed on a front side of the bag.

In some examples, the at least one air outlet may further comprise an air-purifying charcoal filter or carbon filter.

In some examples, the bag may comprise a plurality of filtered air outlets, at least one filtered air outlet being provided on each of: side panels, a back panel and a bottom panel of the bag.

In some examples, the bag may further comprise a pair of hanging straps on a top portion of the bag for suspending the bag.

In some examples, the bag may further comprise inside mesh pockets for holding sports equipment.

In some examples, the air inlet may comprise a filtered mounting port adapted to receive the ventilator.

In some examples, the mounting port may comprise a Velcro™ strip for removably securing the ventilator to the bag.

In some aspects, there is provided a ventilated footwear bag for carrying, storing and drying footwear after use, the ventilated footwear bag comprising: a ventilated compartment having at least one footwear attachment for detachably receiving footwear; a mounting port on the bag for detachably connecting a ventilator for drawing air into the bag and for encouraging air out of the bag through at least one filtered air outlet in the bag; and an exterior pocket on an exterior side of the bag, the exterior pocket having at least one air inlet and at least one air vent.

In some examples, the at least one air inlet of the exterior pocket may be in fluid communication with an interior of the ventilated compartment for receiving air from inside the ventilated compartment, and the at least one air vent of the exterior pocket may vent air outside of the bag.

In some examples, the mounting port for receiving the ventilator and the at least one filtered air outlet may be located on opposing portions of the bag.

In some examples, the bag may further comprise an additional ventilated compartment for storing and drying an article of clothing.

In some examples, the bag may further comprise a plurality of filtered air outlets disposed on at least two different panels of the bag.

In some examples, the mounting port may comprise a Velcro™ strip for removably securing the ventilator to the bag.

In some examples, the bag may further comprise upper and lower harnesses disposed within the bag for detachably securing the footwear at a position within the bag that optimally ventilates the footwear.

The present disclosure describes a ventilated equipment bag, equipment case or portable locker for storing, carrying and drying sports equipment. The portable locker (or container or bag or case) has a structure that defines an enclosure for containing, storing and drying sports equipment. The portable locker has a ventilator (e.g., ventilation fan) mounted in the container structure. The ventilator draws in air and encourages stale and malodorous air to exhaust through one or more air outlets, which, in some examples, include air filters such as carbon or charcoal filters, for example located on side panels, a bottom panel and a rear panel of the locker. The portable locker also includes a closure feature, such as a door, closeable opening or other such access through which equipment can be inserted into or retrieved from the portable locker. In some examples, the door or closeable opening is a zippered fabric panel that closes to substantially contain any odors emanating from the sports equipment. In some examples, the portable locker defines a box-like container having a substantially flat top panel into which the fan is securely mounted. In some examples, the portable locker has hooks and mesh pockets for holding various pieces of sports equipment to facilitate drying of the equipment after use. The portable locker therefore provides a relatively versatile and simple-to-use apparatus for storing, carrying and drying hockey equipment, football equipment or any other sports equipment that is damp and sweaty after a game or practice.

In accordance with one aspect of the present disclosure, there is provided a portable equipment container for storing, carrying and drying sports equipment, the portable equipment container comprising: a structure for containing the sports equipment, the structure being defined by at least one wall; an openable and closable closure feature having an open state, in which sports equipment can be inserted or retrieved, and a closed state, in which the feature cooperates with the structure to substantially fully enclose the sports equipment; a ventilator mounted in a wall of the structure for drawing fresh air into the structure and for encouraging stale air from the structure to exhaust through at least one filtered air outlet located in a wall of the structure; and an exterior pocket on an exterior side of the structure, the exterior pocket having at least one air inlet and at least one air vent.

BRIEF DESCRIPTION OF THE DRAWINGS

Reference will now be made to the accompanying drawings by way of illustration showing example embodiments, in which.

DETAILED DESCRIPTION

Figure 1:
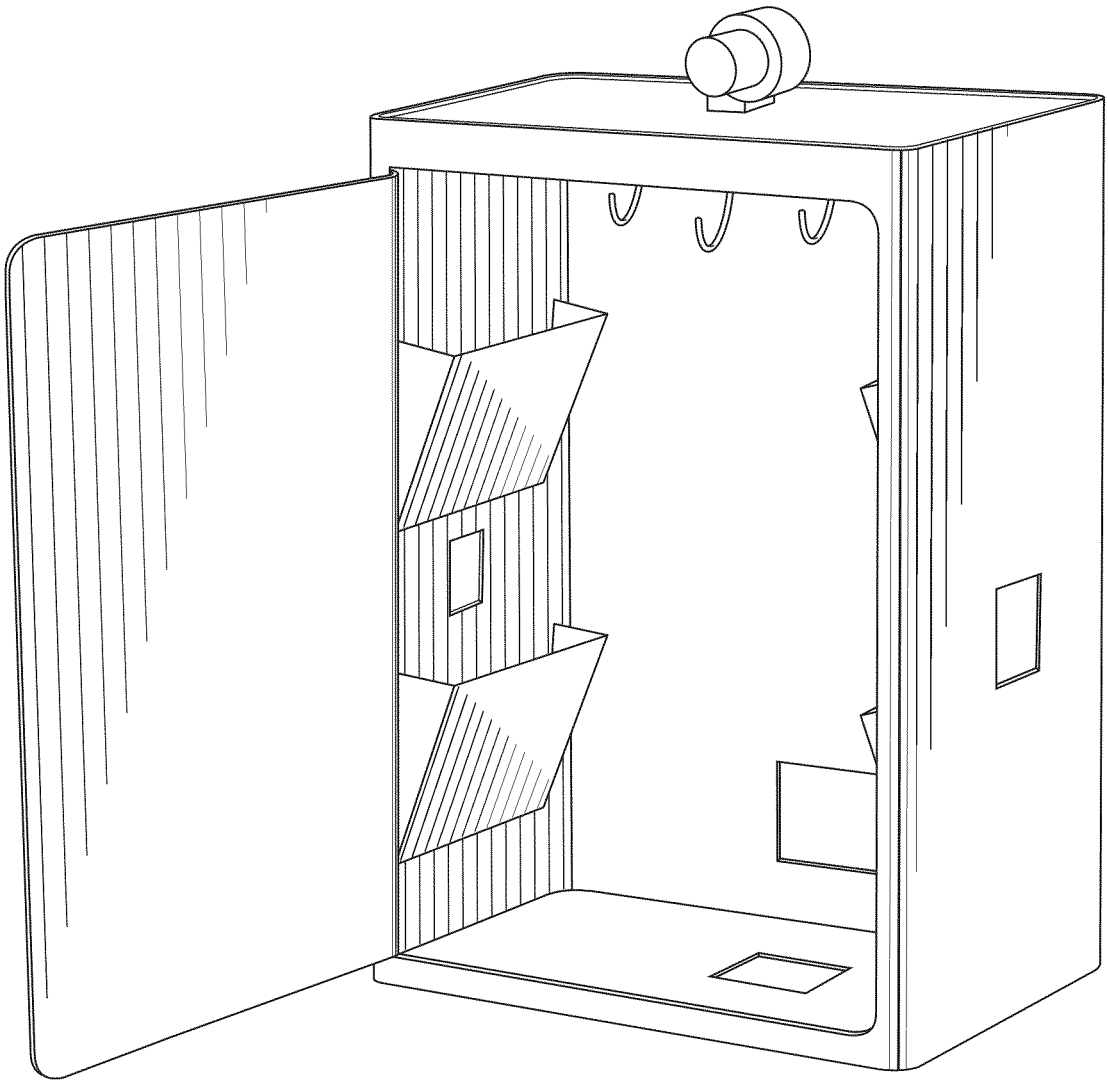
FIG. 1 is an isometric perspective view of a ventilated portable locker in accordance with an embodiment of the present disclosure.
Figure 2:
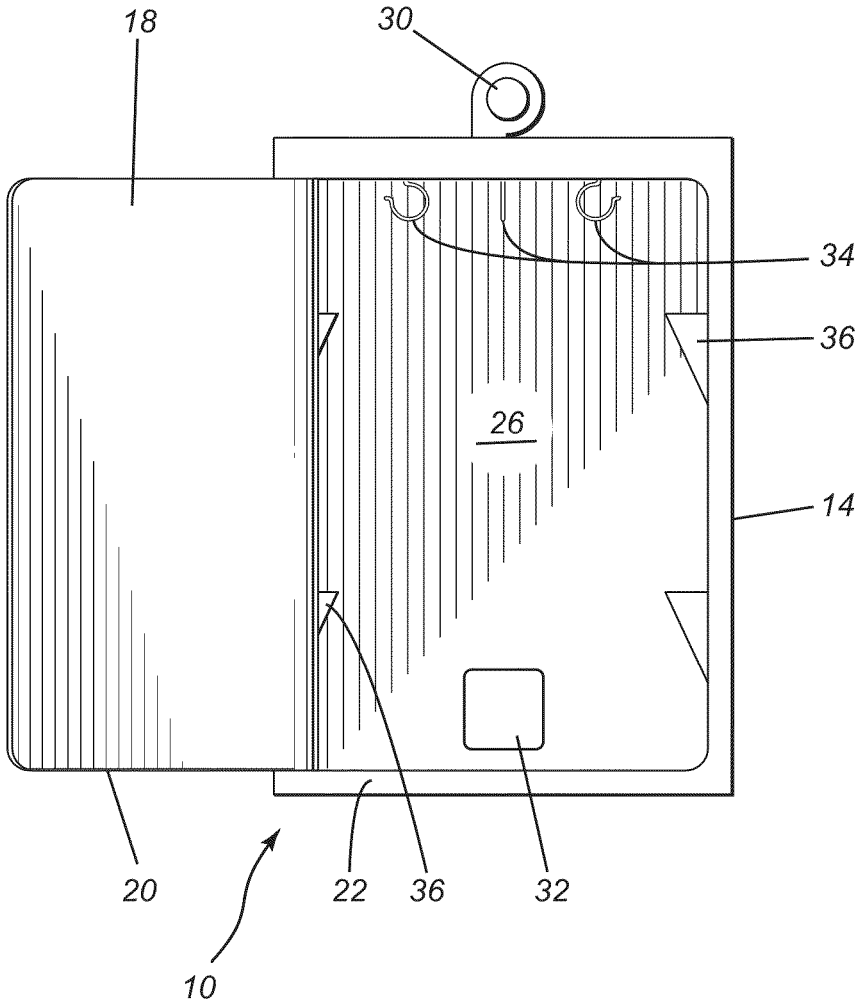
FIG. 2 is a front elevation view of the ventilated portable locker shown in FIG. 1.
Figure 3:
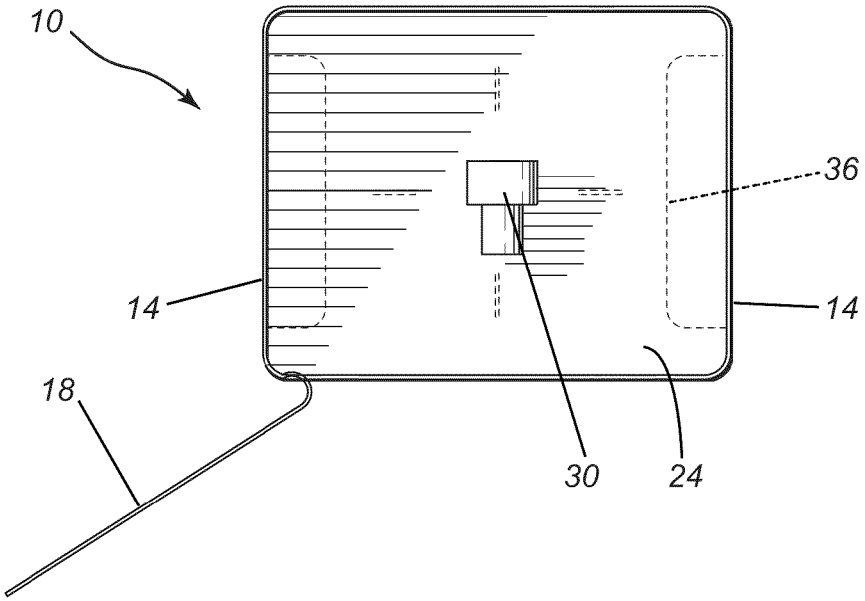
FIG. 3 is a top plan view of the ventilated portable locker shown in FIG. 1.

FIGS. 1 to 3 illustrate a ventilated portable locker in accordance with an example embodiment of the present disclosure. For the purposes of this specification, the portable locker shall also be referred to synonymously as a sports bag, equipment bag or as a forced-ventilation carrying case. As shown in FIGS. 1 to 3, the portable locker, which is generally designated by reference numeral 10, has a container structure 12 that may be box-shaped. In other words, the portable locker may include a pair of opposed side walls or side panels 14, a back panel 16, and a zippered door 18 having a zipper 20 that zips closed to define a front panel. The portable locker 10 also may include a bottom panel 22 and a top panel 24. The side panels, back panel, door, bottom panel and top panel cooperate to define a generally rectangular container structure 12 which in turn defines an enclosure 26 which is a generally rectangular volume as shown in FIGS. 1 to 3. After a game or practice, damp sports equipment can be stored, carried and dried within the enclosure 26 as will be described below. While the illustrated shape of the container structure of the portable locker represents the best mode known to the Applicant, the container structure could have a variety of different shapes, for example that of a typical hockey bag in which case the "panels" referred to above would refer to front, back, side, top and bottom "portions" of the bag.

As further illustrated in FIGS. 1 to 3, the top panel 24 includes an air inlet 28 and a ventilation fan 30 mounted in fluid communication with the air inlet to draw air into the container structure of the portable locker. The ventilation fan 30 is electrically powered and includes a standard power cord (not shown) for plugging the fan into an electric wall outlet.

The panels of the portable locker may be made of a nylon fabric which will tend to inflate slightly, ("puff up") under a positive pressure from the fan, which will consequently force stale and malodorous air to exhaust through at least one filtered air outlet 32.

As shown in FIG. 1, in some examples the portable locker 10 also includes a plurality of filtered air outlets 32. In the example embodiment shown, the air outlets are equipped with air-purifying filters, such as carbon or charcoal filters, for purifying the air as it exhausts from the portable locker. In some examples, all air outlets 32 include air-purifying filters, such as carbon or charcoal filters. In some examples, the air inlet 28 is also provided with an air-purifying filter, such as a carbon or charcoal filter.

Figure 4:
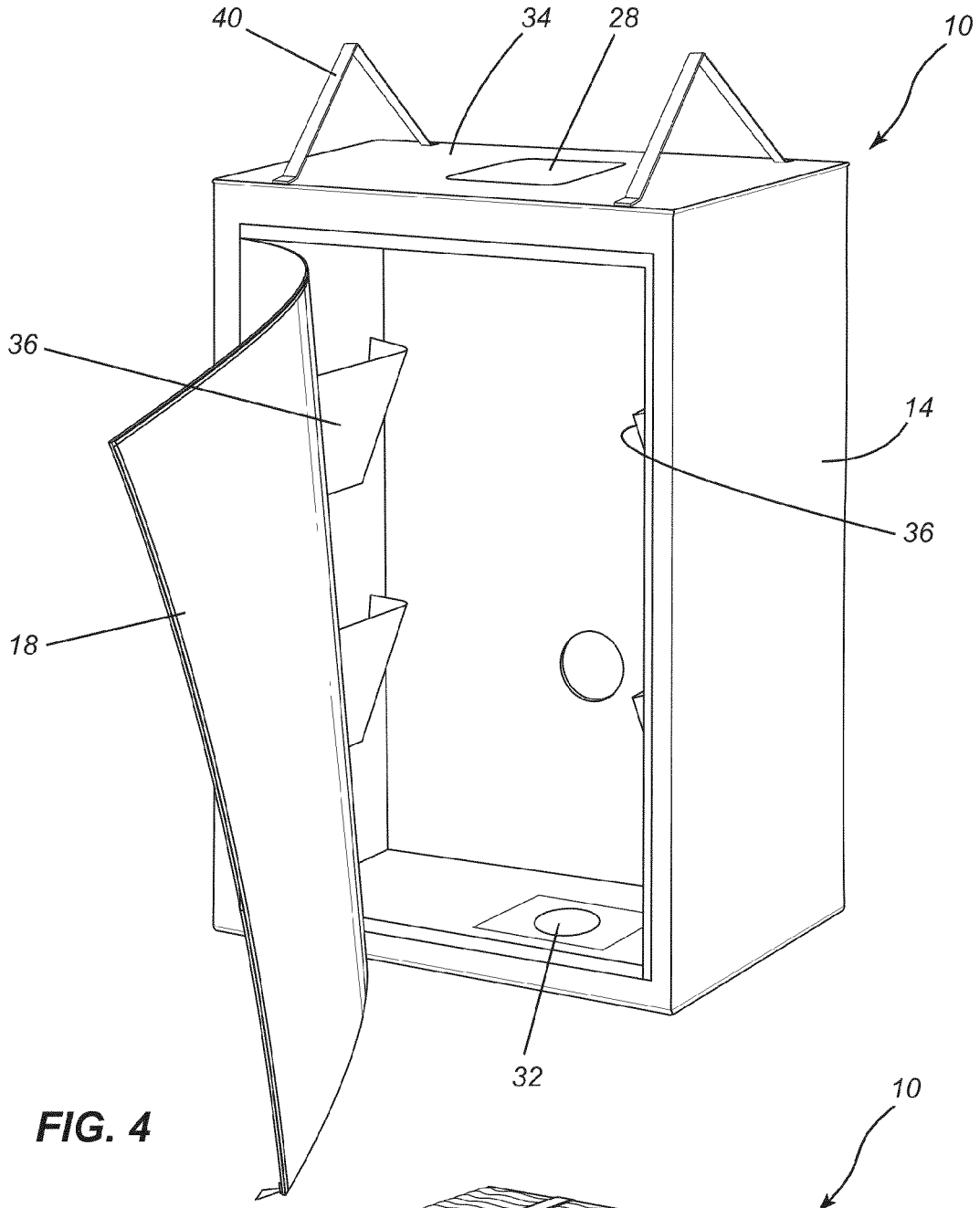
FIG. 4 is an isometric perspective view of the preferred embodiment of the ventilated portable locker shown with hanging straps disposed on a top panel of the portable locker.

FIG. 4 is an isometric perspective view of the example embodiment of the ventilated portable locker shown with hanging straps 40 disposed on a top panel 34 of the portable locker 10. The hanging straps 40 enable the portable locker to be suspended from a hook in a locker, for example. The hanging straps 40 can be made of nylon with adjustable lengths. As will be appreciated by those of ordinary skill in the art, the position of the straps on the top panel can be varied. Alternatively, the straps can be connected to the sides of the portable locker rather than to the top panel.

Figure 5:
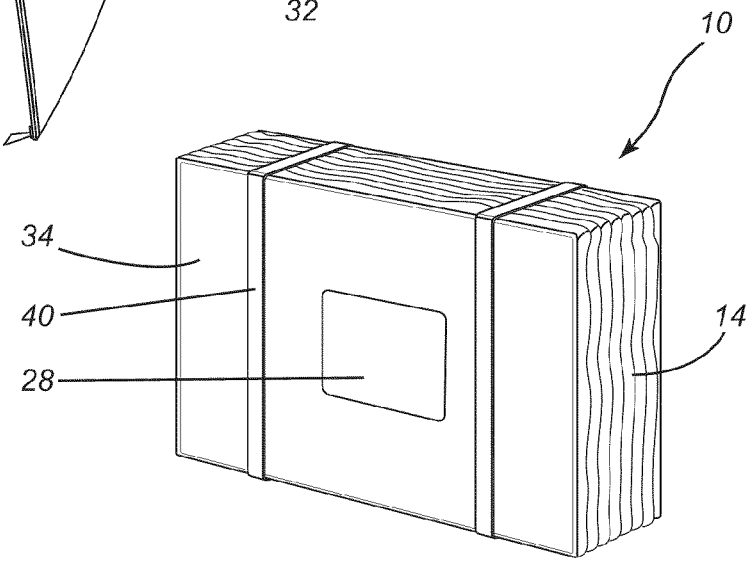
FIG. 5 is a an isometric perspective view of the ventilated portable locker of FIG. 4 after it has been folded up for carrying sports equipment in a compact travel mode.

FIG. 5 is a an isometric perspective view of the ventilated portable locker of FIG. 4 after it has been folded up for carrying sports equipment in a compact travel mode. The hanging straps 40 wrap around the folded locker to form a traveling case that is compact and easy to carry. Additional handles can be provided on the case to facilitate carrying.

As a further variant, the portable locker could further include a timer to automatically shut off the ventilation fan after a given period of time in order to save energy. The timer could allow a user to select a one of number of predetermined drying cycles.

As a further variant, the portable locker could further include a heater to accelerate drying of the sports equipment, as hot dry air is better able to absorb moisture. However, as will be appreciated by those of ordinary skill in the art, some sports equipment will degrade over time if exposed to excessive heating and cooling cycles so the heater should not overheat the equipment. In some examples, the portable locker does not include a heat source for drying, to avoid degradation of locker contents.

In yet a further variant, the portable locker could also include a small control panel integrally mounted on the locker, or an in-line timer, for allowing a user to easily control the optional timer and the optional heater. In some examples, the portable locker may further include an automatic spray that is controlled by the timer, for example to automatically spray a disinfectant and/or anti-odor spray into the portable locker at set times or set time intervals.

In a further example, the portable locker can include one or more air fresheners and/or air disinfectants for scenting and/or disinfecting the air within the locker. Alternatively, specially dimensioned mesh pockets can be provided to receive replaceable air fresheners and/or air disinfectants which can be replaced periodically when their scent and/or disinfecting property is depleted.

Figure 6:
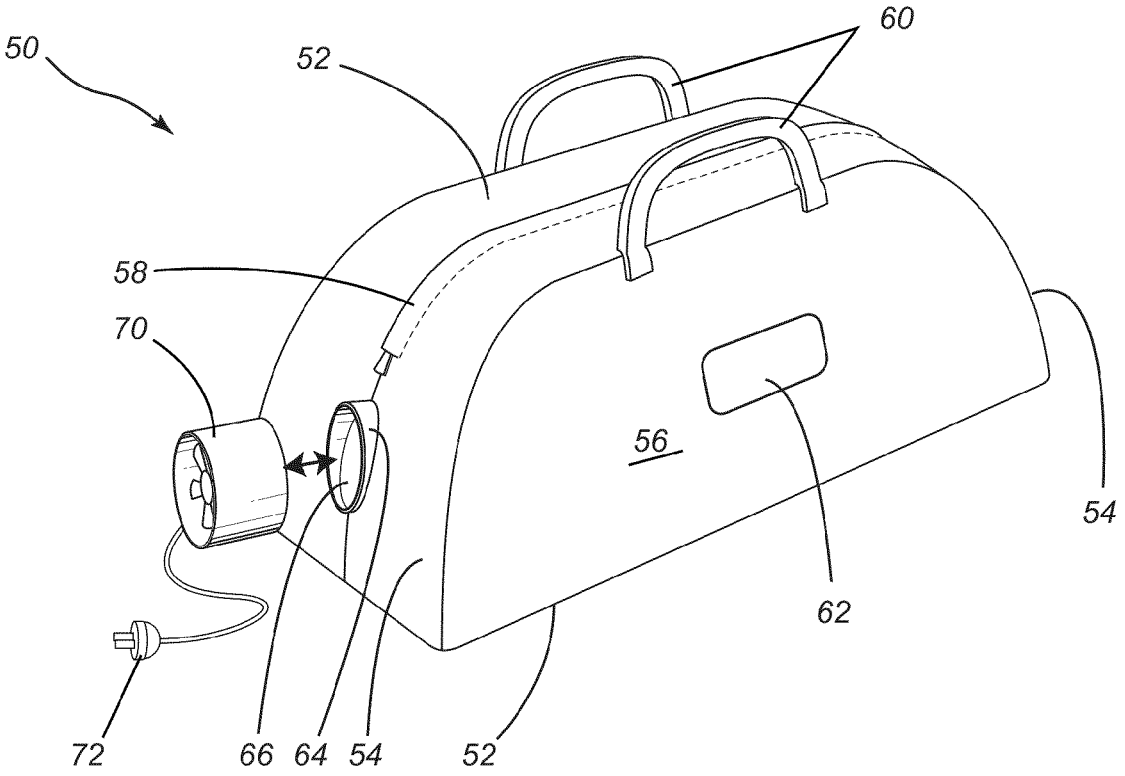
FIG. 6 is an isometric perspective view of a ventilated sport bag with a detachable fan in accordance with another embodiment of the present disclosure.

FIG. 6 is an isometric perspective view of a traveling bag with a detachable fan unit in accordance with another embodiment of the present disclosure. As shown in FIG. 6, the traveling bag is a ventilated sports equipment bag 50 having opposed top and bottom panels 52, opposed front and rear panels 54, and opposed side panels 56. A zipper 58 is disposed along the length of the top panel 52 to open and close the bag. A pair of handles 60 is disposed on the bag to facilitate carrying of the bag. At least one filtered air outlet 62 is provided in one or more of the panels of the bag. In FIG. 6, for simplicity of illustration, only a single filtered outlet 62 is shown in side panel 56, but it should be expressly understood that any number of such outlets can be provided in various panels of the bag. In some examples, a plurality of filtered outlets 62 is provided in various panels of the bag to provide ventilation.

As further illustrated in FIG. 6, the ventilated sports bag 50 also includes a mounting port 64 formed in a panel of the bag, in this example the front panel 54. The mounting port 64 may include a filter 66. The mounting port is designed to receive a detachable fan 70 which can be removably (i.e. temporarily) connected to the bag in order to perform a forced ventilation of the bag. The detachable fan 70 has an electrical cable and plug 72 that can be plugged into a standard electrical wall outlet or a DC outlet (e.g., a 12 volt outlet).

Figure 7:
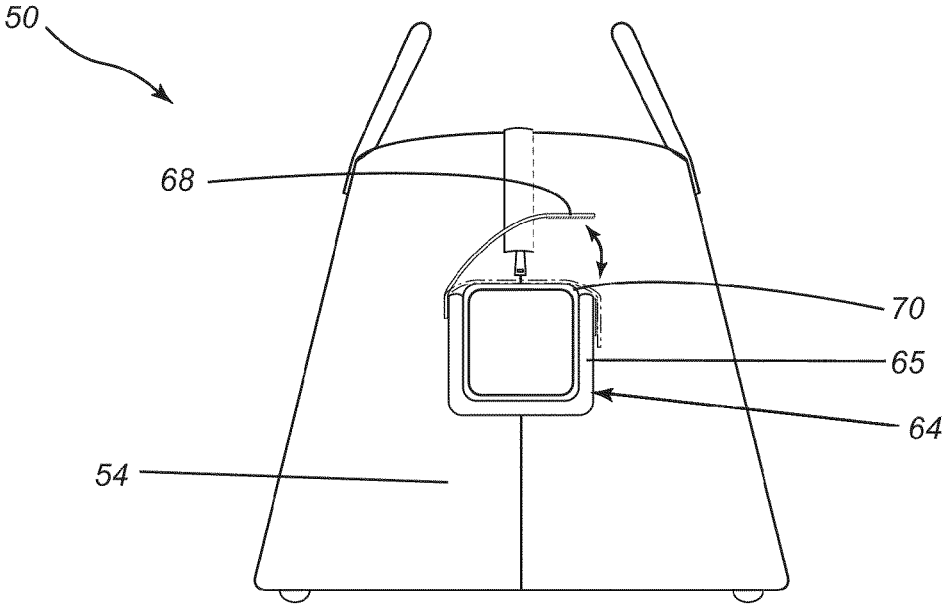
FIG. 7 is a front elevation view of a method of detachably connecting the detachable fan to a front panel of the bag of FIG. 6.

FIG. 7 shows an example method of connecting the detachable fan to the sports bag. FIG. 7 is a front view of the front panel 54 of the sports bag 50. The detachable fan 50 can be connected to the sports bag 50 via a Velcro™ strip 68 which wraps and unwraps around the top of the fan 70. The Velcro™ strip attached to a cradle portion 65 of the mounting port 64. The cradle portion supports the fan against the front panel 54. In this figure, a fan with a square body is shown rather than a fan with a cylindrical body (as was shown in FIG. 6) to underscore that any number of differently sized and shaped fans can be used with the present disclosure.

FIGS. 8 to 11 illustrate a ventilated footwear bag in accordance with yet another embodiment of the present disclosure. The ventilated footwear bag, generally designated by reference numeral 80, is designed for carrying, storing and drying footwear after use, particularly after athletic use or other non-athletic physical exertion. In different variants, the ventilated footwear bag 80 can be sized and shaped to store and dry any pair of footwear for either an adult or a child, such as but not limited to: running shoes (including jogging shoes, basketball shoes, cross-trainers, etc.); cleated shoes such as soccer cleats, golf shoes, baseball and software cleats; ice skates including hockey skates for players and goalies, figure skates as well as in-line skates or roller skates; downhill or cross-country ski boots and snowboard boots; hiking boots, construction boots, work boots, etc. For greater certainty, it should be expressly understood that the ventilated footwear bag of the present disclosure can be dimensionally adapted to be used with any other type of footwear not explicitly mentioned.

As shown in FIGS. 8 to 11, the ventilated footwear bag 80 includes a bag enclosure defining a ventilated compartment 82 for receiving footwear 84, e.g. a single adult-sized (or child-sized) pair of shoes, skates or boots. In an example embodiment of the ventilated footwear bag, the bag is dimensioned to accommodate a single pair of either adult-sized or child-sized footwear. In a variant, the bag can be sized to receive two or more pairs of footwear. For example, the bag could be designed to house two pairs of shoes (or skates) for a couple or for a parent and child.

As shown in FIGS. 8 to 11, the ventilated footwear bag 80 includes a mounting port 86 disposed on the bag for detachably connecting a fan 88 for drawing air into the bag and for forcing air out of the bag through at least one vent or filtered outlet 90 in the bag. The fan may be electrically powered and includes a power cord 92 that connects into a standard electrical outlet. In another variant, the device can include a rechargeable battery to provide a temporary energy source while the bag is being transported home. The fan can include an optional heater and/or a timer to optimize drying and/or energy savings. In some examples, a heater is not included.

Figure 8:
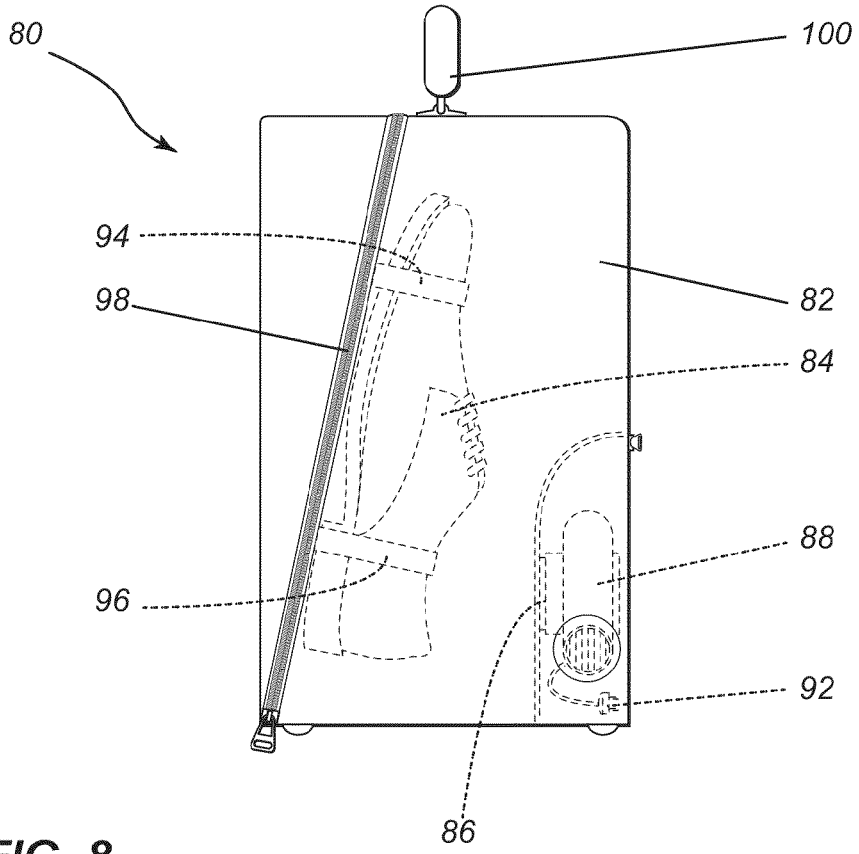
FIG. 8 is a side cutaway view of a ventilated footwear bag in accordance with another embodiment of the present disclosure.
Figure 9:
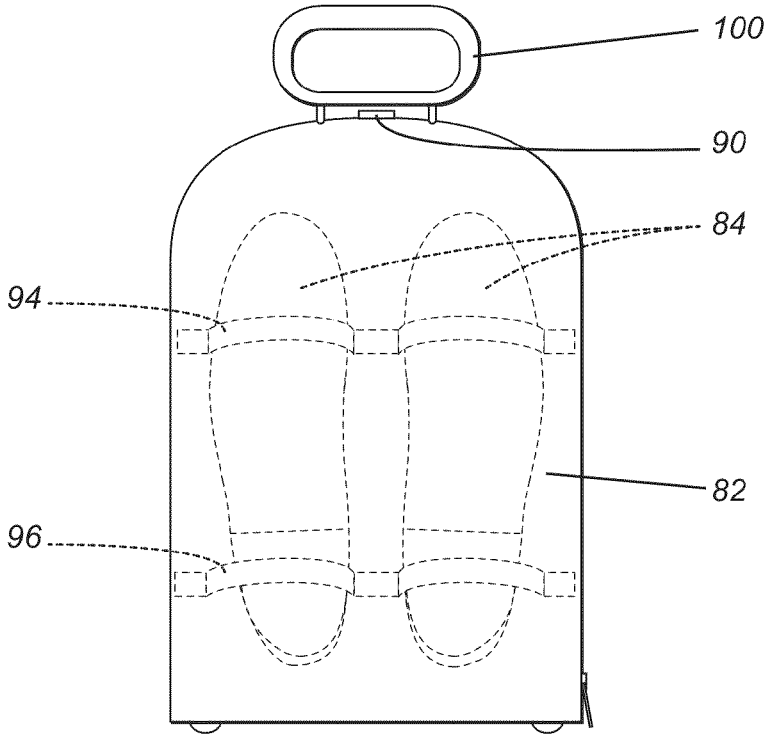
FIG. 9 is a front cutaway view of the ventilated footwear bag of FIG. 8, showing a pair of shoes retained within the bag by upper and lower harnesses.
Figure 10:
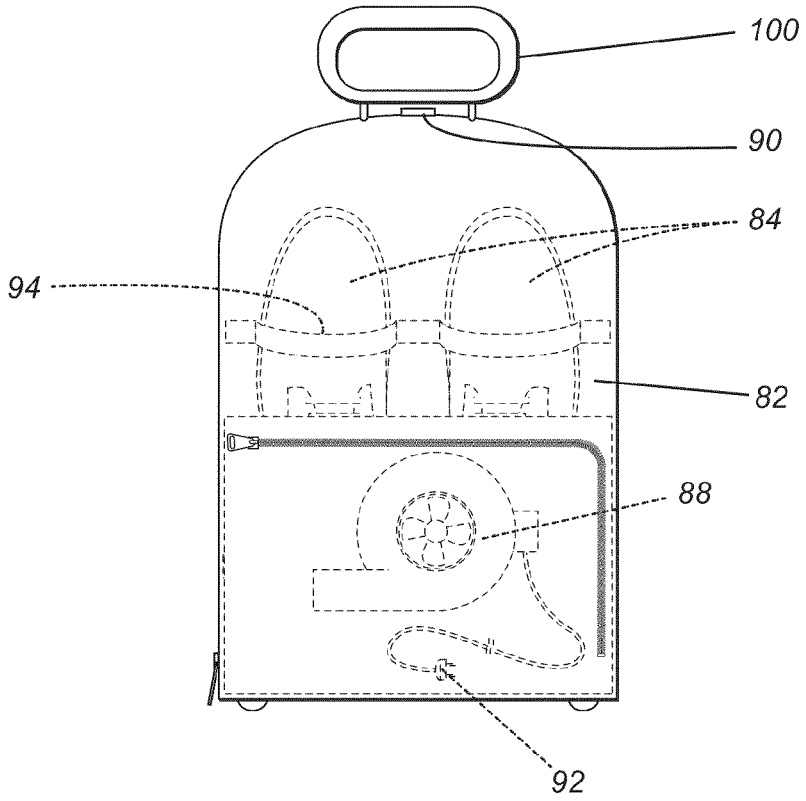
FIG. 10 is a rear elevation view of the ventilated footwear bag of FIG. 8, showing the upper and lower harnesses in stippled lines.

As shown in FIGS. 8 to 11, the ventilated footwear bag 80 includes at least one footwear attachment for detachably receiving the footwear within the bag. In the example embodiment of the ventilated footwear bag, there are two footwear attachments, namely an upper harness 94 and a lower harness 96 which can be used to detachably secure the footwear to interior surfaces of the bag. As shown in FIGS. 9 and 10, the harnesses may be affixed to interior surfaces of the side panels of the bag. The footwear may be secured in an inclined position as shown in FIG. 8 in order to help improve drying of the footwear, i.e. to help improve the orientation and location of the footwear relative to the fan. The upper and lower harnesses can include Velcro™ straps, belts, buckles or any other known means for flexibly restraining shoes, skates or boots without unduly deforming them. The harnesses can be made of nylon, leather or other known materials that flexibly conform to the shape of the footwear when attached. In some examples, the upper and lower harnesses each include a length adjustment mechanism for adjusting the length of the straps to accommodate footwear of varying sizes and shapes.

Figure 11:
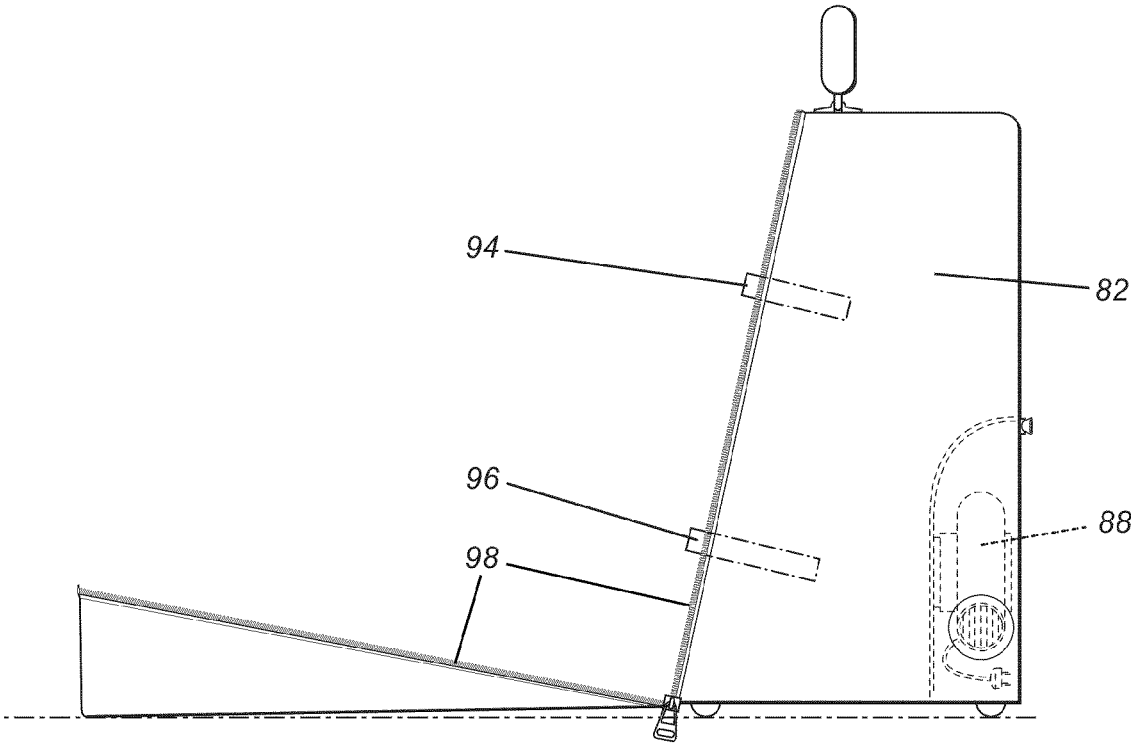
FIG. 11 is a side elevation view of the ventilated footwear bag of FIG. 8, showing the bag in an open, unzipped position.

As shown in FIGS. 8 and 11, the ventilated footwear bag includes a zipper 98 that unzips to provide access to the interior of the bag and then zips to provide a substantially airtight or hermetic enclosure for the footwear to be dried. FIG. 8 shows the bag in the closed, or "zipped", position while FIG. 11 shows the bag in the open, or "unzipped" position. As will be appreciated by those of ordinary skill in the art, while the zipper position shown in the figures represents an example position in order to optimize access and minimize interference, the zipper can also be relocated to another position. Similarly, the zipper could be replaced with other closure means such as Velcro™.

The ventilated footwear bag can also be constructed either as a true bag with floppy panels or it can be constructed with rigid panels in the form of a portable locker, such as described above with reference to the first embodiment. In other words, the ventilated footwear bag can be designed and constructed as a "portable shoe locker" or "portable skate locker". In any of the embodiments, the ventilated footwear bag may include at least handle 100. As shown in FIGS. 8-11, the handle 100 may extend upwardly from the top surface of the top panel. In another example, the handle is centrally disposed on the top panel such that it straddles the filtered outlet on the top panel. The handle can, of course, be located elsewhere. Alternatively, two or more handles or carrying straps can be symmetrically affixed to sides of the bag. In another variant, the bag/portable locker 80 can also have a telescopically retractable handle and two or more wheels, rollers or casters on an underside thereof, as are found on some suitcases in order to facilitate transport of the bag. As will be readily appreciated by those of ordinary skill in the art, any number, type and configuration of externally mounted pouches or clip-on accessories, e.g. a clip-on water bottle, can be readily added to the bag as accessories or add-ons. For example, a glove holder 102 having a Velcro™ strap or other holding means can be connected to an upper front face of the bag.

Figure 12A:
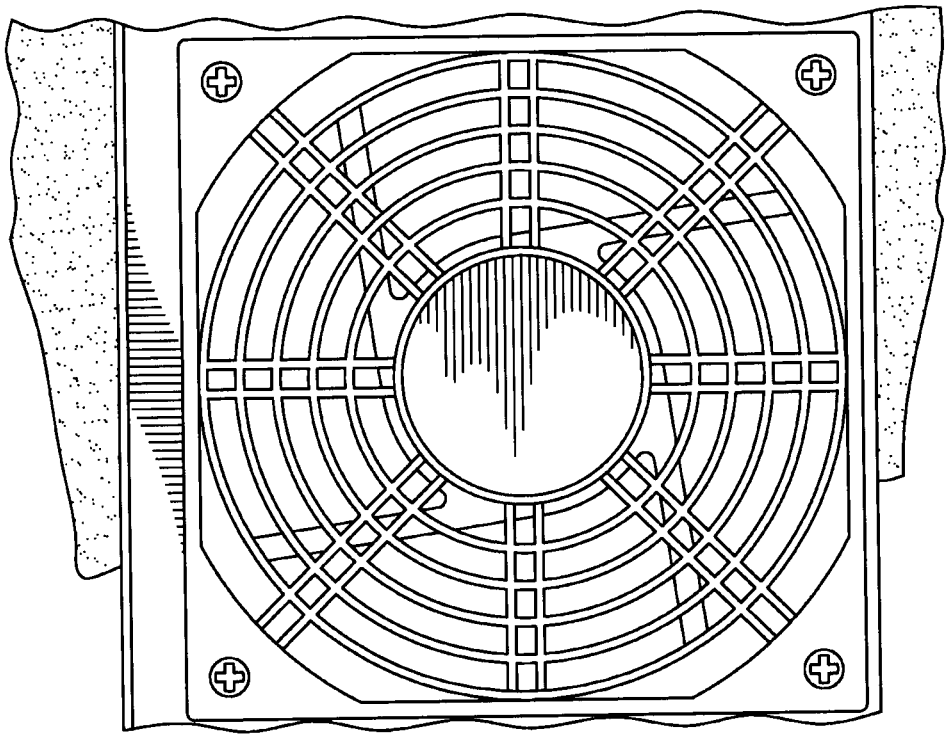
FIG. 12A and FIG. 12B shows an example non-detachable fan suitable for the ventilated bag, in accordance with some examples of the present disclosure.
Figure 12B:
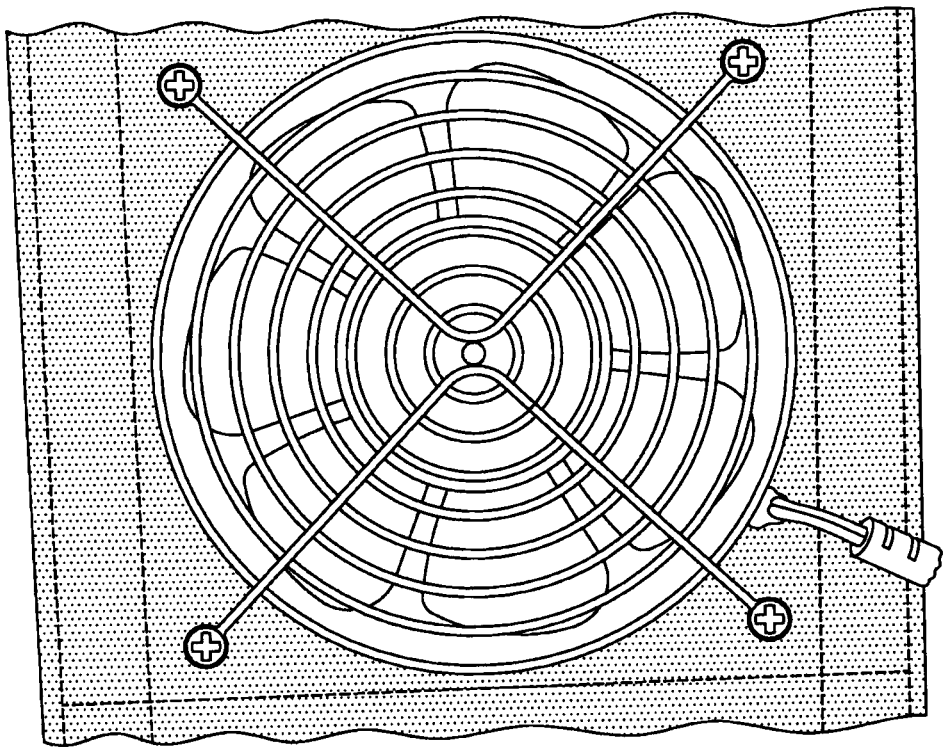
Figure 13A:
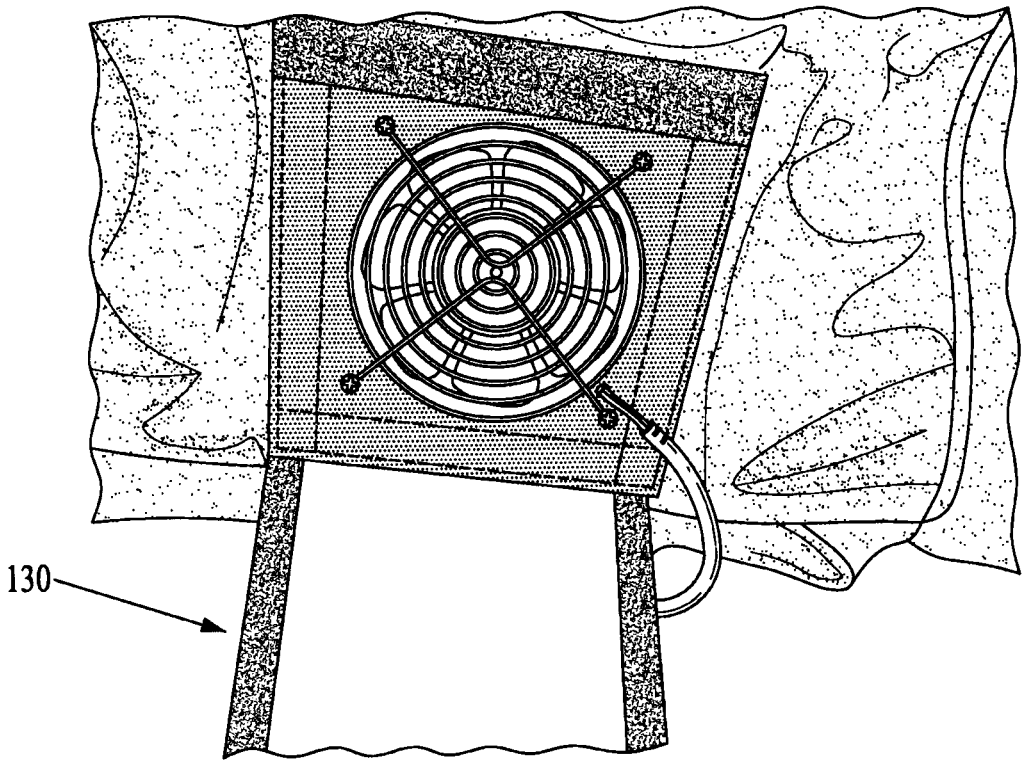
FIG. 13A shows the non-detachable fan of FIG. 12A and FIG. 12B with an example protective shield.

Although some of the examples describe a detachable fan for the ventilated bag, in other examples, the fan may be non-detachable. For example, a detachable fan may be useful where the ventilated bag is designed to be hung (such as in FIG. 4) or a non-detachable fan may be useful where the ventilated bag is designed to be carried or used with a carrier (such as in FIG. 21 or FIG. 22) A non-detachable fan may be useful to help in avoiding the fan being unintentionally left behind or misplaced. A non-detachable fan may also help to simplify operation and set-up of the ventilated bag. Examples of suitable non-detachable fans are shown in FIG. 12A, FIG. 12B and FIG. 13A. FIG. 12A shows the example fan as viewed from the interior of the bag and FIG. 12B shows the example fan as viewed from the exterior of the bag. In the example shown in FIG. 13A, the fan is provided with a protective shield 130. The shield 130 may be a detachable flap (e.g., made of the same material as the bag, such as nylon) that is secured (e.g., using a securing mechanism such as Velcro or snap-on fasteners) around the edges of the fan mount. The securing mechanism may be configured to form a relatively protective seal around the shield 130 (e.g., impermeable to large particles such as dirt, or liquid-impermeable). The shield 130 may help to protect the fan from debris such as dirt, water, snow, etc. The shield 130 may allow the fan to be attached to the bag even in conditions that may otherwise damage the fan (e.g., in certain outdoor environments), and may be particularly useful for a non-detachable fan, although the shield 130 may also be provided even where the fan is detachable. The shield 130 may be a flap with one side permanently fixed to the bag or may be fully detachable from the bag. Although the shield 130 is shown provided on the exterior of the bag, the shield 130 may be additionally or alternatively provided on the interior of the bag.

Figure 13B:
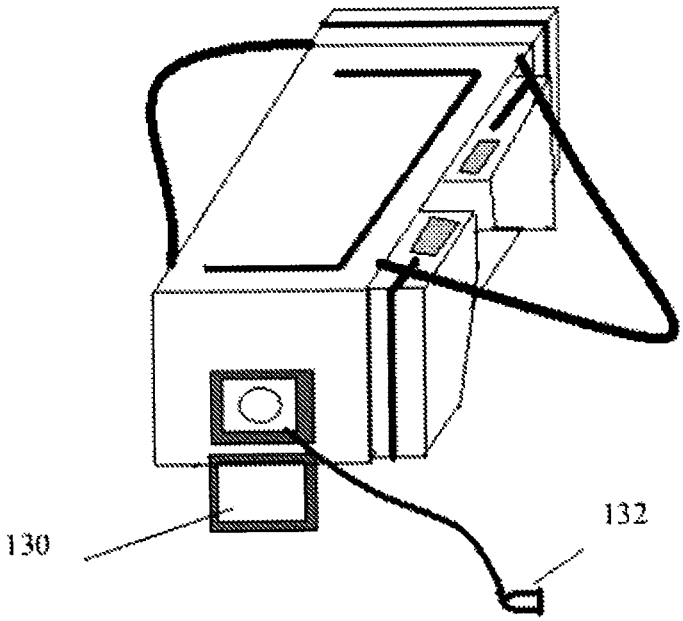
FIG. 13B shows an example of the ventilated bag including an example protective shield and an example power cable.

FIG. 13B shows an example where the fan (e.g., an AC/DC fan), whether detachable or non-detachable, may include a power cable 132 for connecting with a power plug in a vehicle (e.g., a car, a van or a SUV) or other suitable source. The ability to power the fan using a power source in a vehicle may be useful to allow drying of articles in the ventilated bag during travel time, without the added bulk or weight and limited battery life of a battery pack. In other examples, a power source, such as a battery pack or other suitable power source, such as solar panels, may be included in the ventilated pack.

Figure 14:
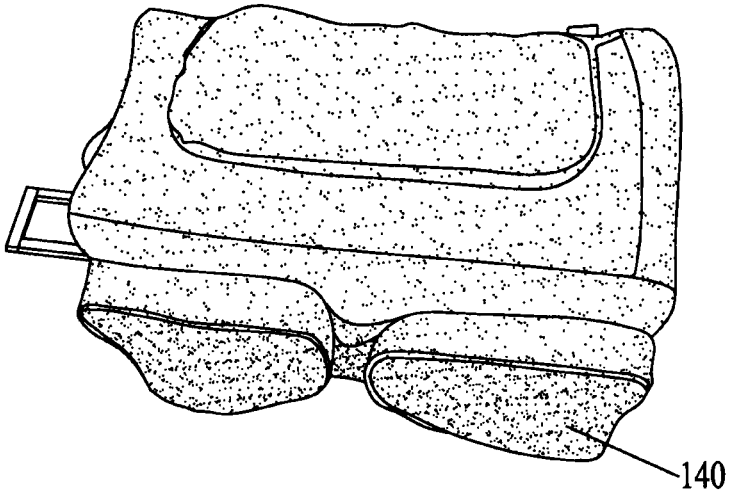
FIG. 14 and FIG. 15 show examples of the ventilated bag with exterior pockets, in accordance with some examples of the present disclosure.
Figure 15:
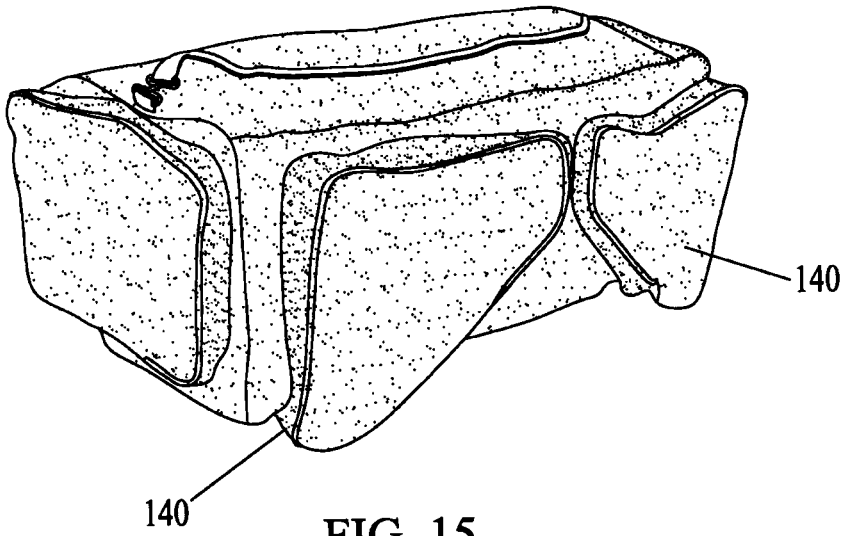
Figure 16:
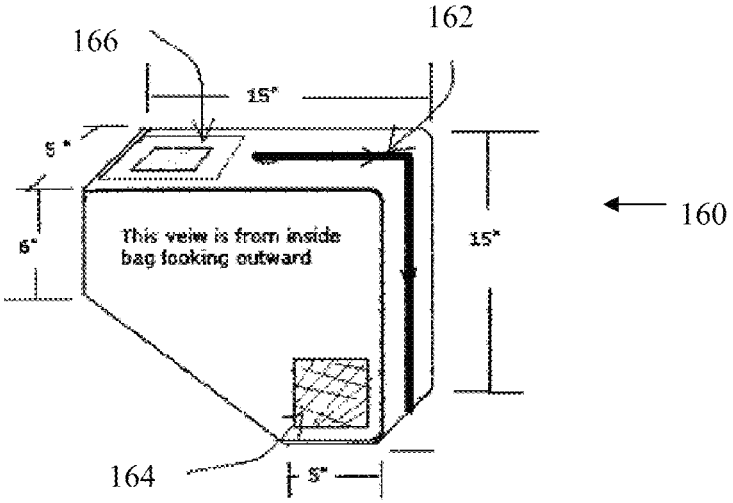
FIG. 16 is a schematic diagram showing an example of an exterior pocket suitable for the ventilated bag, in accordance with some examples of the present disclosure.

FIG. 14 and FIG. 15 show example ventilated bags having at least one and possibly two or more exterior pockets 140, which may be suitable for holding equipment, such as skates. A diagram of an example exterior pocket 10 is shown in FIG. 16, where the example pocket 160 is configured to hold a skate. Although the example pocket 160 is shown with certain dimensions indicated, these are for the purpose of illustration only. The exterior pocket 140, 160 may be configured to house other contents, including other footwear. Typically, footwear (e.g., skates or boots) are quite wet after a game or other such activity.

The example pocket includes a zipper 162 for opening and closing the pocket 160, which is shown positioned along two sides of the pocket, however the zipper 162 or other opening and closing means may be positioned elsewhere on the pocket. The example pocket also includes a screened inlet 164 and a vent 166, which may allow for circulation of air through the pocket 160. Circulation of air through the pocket 160 may allow the pocket contents (e.g., damp skates or other footwear) to dry more efficiently. The vent 166 in the pocket 162 may include carbon filters, as described above. In some examples, all pocket vents 166 and other air outlets 32 are provided with air filters, such as carbon filters, which may help to prevent odors from being vented out of the bag. In the example shown, the inlet 164 is positioned on a side of the pocket 160 facing inwards towards the bag and the vent 166 is positioned on a side of the pocket 160 that is external to the bag, thus the inlet receives air from inside the bag and the vent 166 vents air out of the bag. Other inlet 164 and vent 166 placements may be suitable. For example, both the inlet 164 and vent 166 may be positioned on a side of the pocket 160 facing inwards towards the bag, such that air from the pocket 160 is vented inside the bag. In another example, both the inlet 164 and vent 166 may be positioned on an external side of the pocket 160, such that air external to the bag is allowed to passively circulate through the pocket 160. A separate exterior pocket may be useful for streaming air, for example a majority of the air, entering the bag into these pockets and directly venting the moist air out of the bag. This may help to speed up the drying process for the contents of the pocket.

Figure 17:
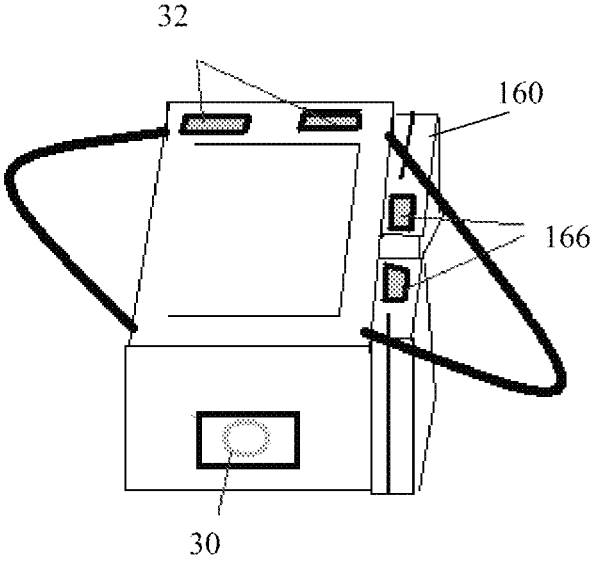
FIG. 17 shows an example ventilated bag having exterior pockets.

FIG. 17 show an example ventilated bag having two exterior vented pockets 160. In this example, the bag includes two main bag vents (e.g., having carbon air filters) positioned on the main container of the bag at the end opposite to the fan mount, which may allow air from the fan to pass through the entire length of the main container, including any contents in the main container of the bag. Each exterior pocket 160 also includes a pocket vent (e.g., having a carbon air filter) to allow air to move through the contents of the pocket (e.g., a skate, a boot or other footwear), which may help to speed up drying of the contents.

Figure 18A:
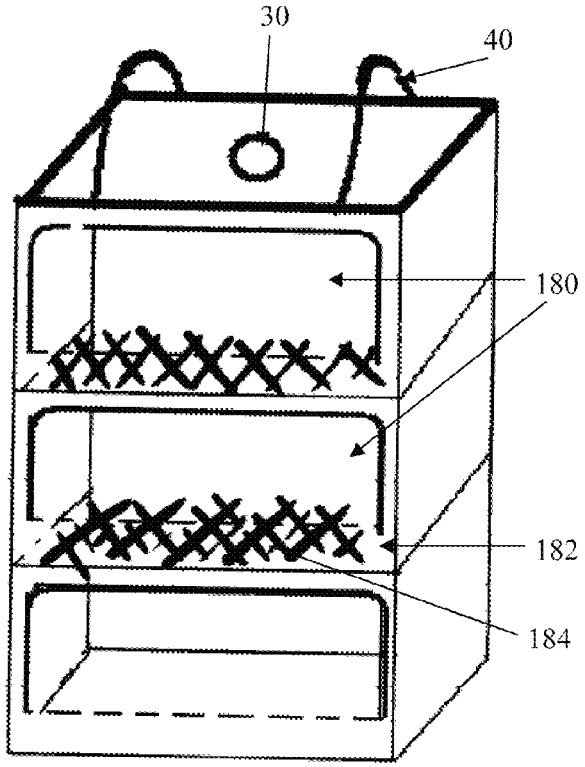
FIG. 18A-B are front perspective and cutaway views of example ventilated bags having multiple compartments.

FIG. 18A shows an example of a ventilated portable locker having multiple compartments 180, each of which may be similar to the container structure 12 described above. In the example shown, the locker has three individual compartments 180, although the locker may have more or fewer compartments. The example locker includes a fan 30, shown located at the top of the locker, although other placement may also be suitable. The compartments 180 are separated by partitions 182, which include a mesh portion 184, such that air can circulate among the compartments. In the example shown, the mesh portion 184 covers the entire partition 182, although in other examples, only a portion of the partition 182 may include the mesh portion 184. The example locker also includes a pair of hanging straps 40 for hanging the locker, for example from a hotel luggage rack or in a closet. Alternatively or in addition, the locker may include rollers or wheels for moving the locker along the ground. Each individual compartment 180 may be separately accessible through a zippered door, alternatively, all compartments 180 may share a single access, such as a single zippered door. This example locker may also include vents or air outlets 32 for venting air out of the locker, for example as described above. For example, the air outlets 32 may be positioned to vent air out the back of the locker (i.e., opposite from the access door), to allow two or more such lockers to be positioned side-by-side without blocking the air outlets 32.

Figure 18B:
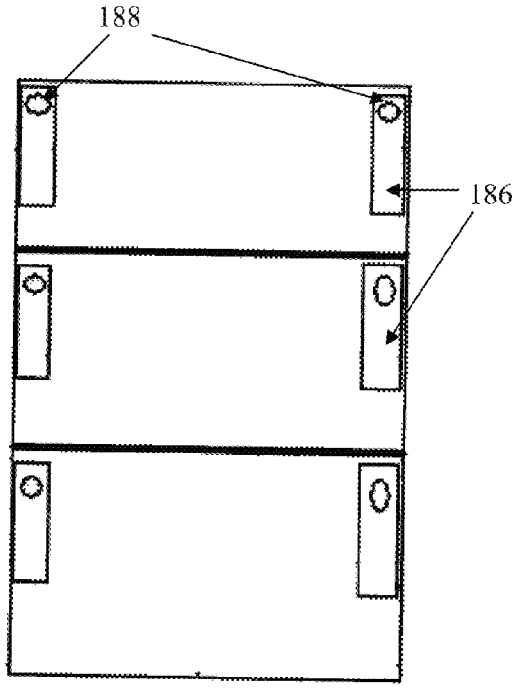
Figure 19:
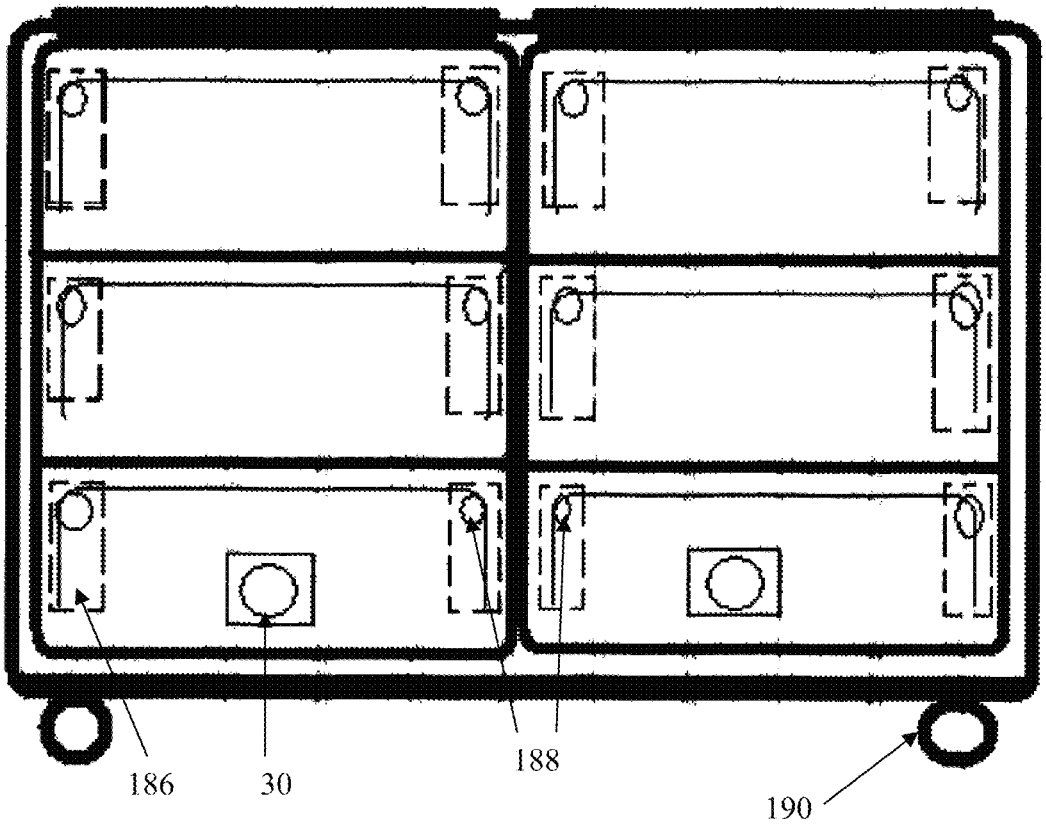
FIG. 19 shows two ventilated bags of FIG. 18A positioned side by side.

FIG. 18B shows a variation of the locker of FIG. 18A, where the locker includes interior pockets 186, which may be suitable for holding footwear, sports equipment (e.g., skates), or other items. The interior pockets 186 may be similar to the exterior pockets 160 describe above and may include pocket vents 188. The pockets 186 may be provided on the interior of the locker rather than the exterior to allow two or more lockers to be positioned side by side without hindrance, for example as shown in FIG. 19, where two example lockers are positioned side by side on a roller cart 190. In the example of FIG. 19, the fan may be positioned near the bottom of each locker. In some examples, the air outlets 32 may be pocket vents 188. The locker may include only pocket vents 188 and no other air outlet 32 for the compartment 180, which may allow air to be fully vented through the contents of both the compartment 180 and the interior pockets 186.

Figure 20:
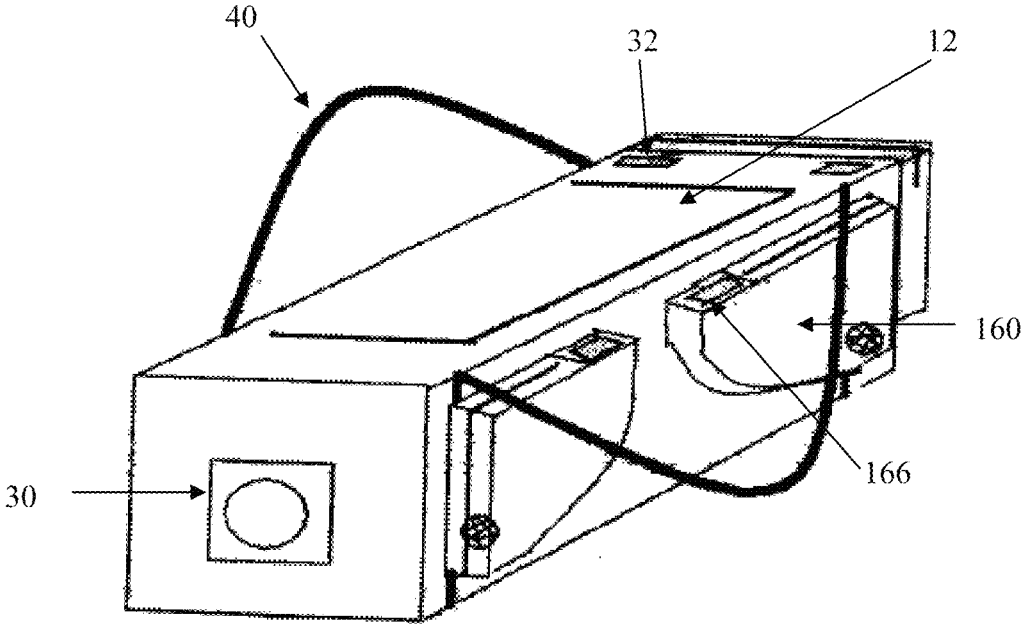
FIG. 20 shows an example ventilated bag that is suitable for hockey equipment.

FIG. 20 shows an example ventilated bag that may be suitable for holding hockey equipment, or any other general sporting or non-sporting equipment. In this example, the bag includes a single container structure 12, carrying or hanging straps 40 and exterior vented pockets 160. There may be two or more air outlets 32 (e.g., with carbon filters) for venting the container structure 12.

Figure 21:
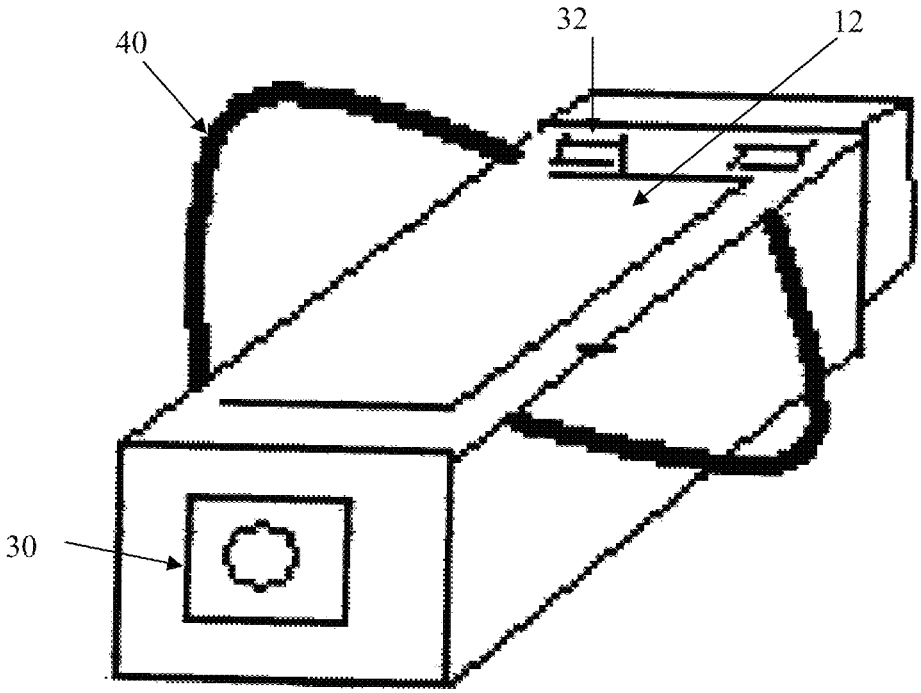
FIG. 21 shows an example ventilated bag that is suitable for lacrosse equipment.

FIG. 21 shows an example ventilated bag that may be suitable for holding lacrosse equipment, or any other general sporting or non-sporting equipment. In this example, the bag includes a single container structure 12 and carrying or hanging straps 40. There may be two or more air outlets 32 (e.g., with carbon filters) for venting the compartment.

Figure 22:
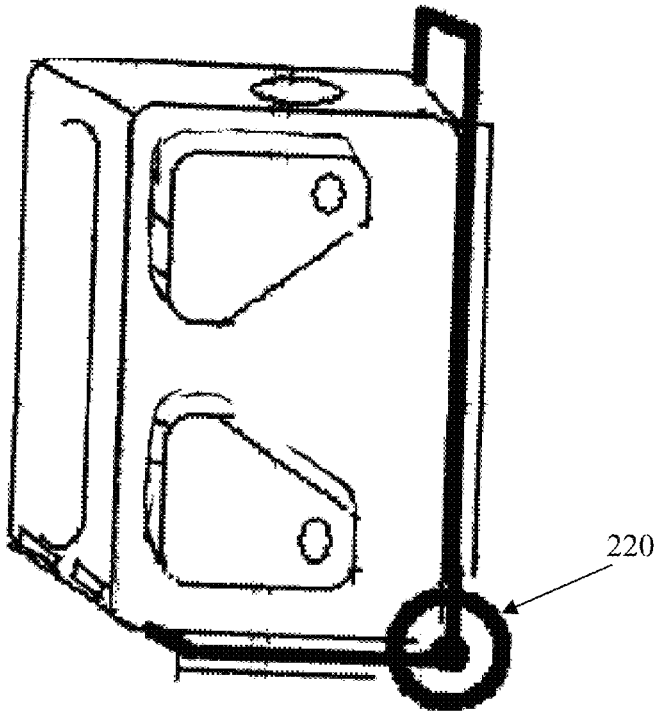
FIG. 22 shows an example ventilated bag including a roller carrier, that is suitable for hockey equipment.
Figure 23:
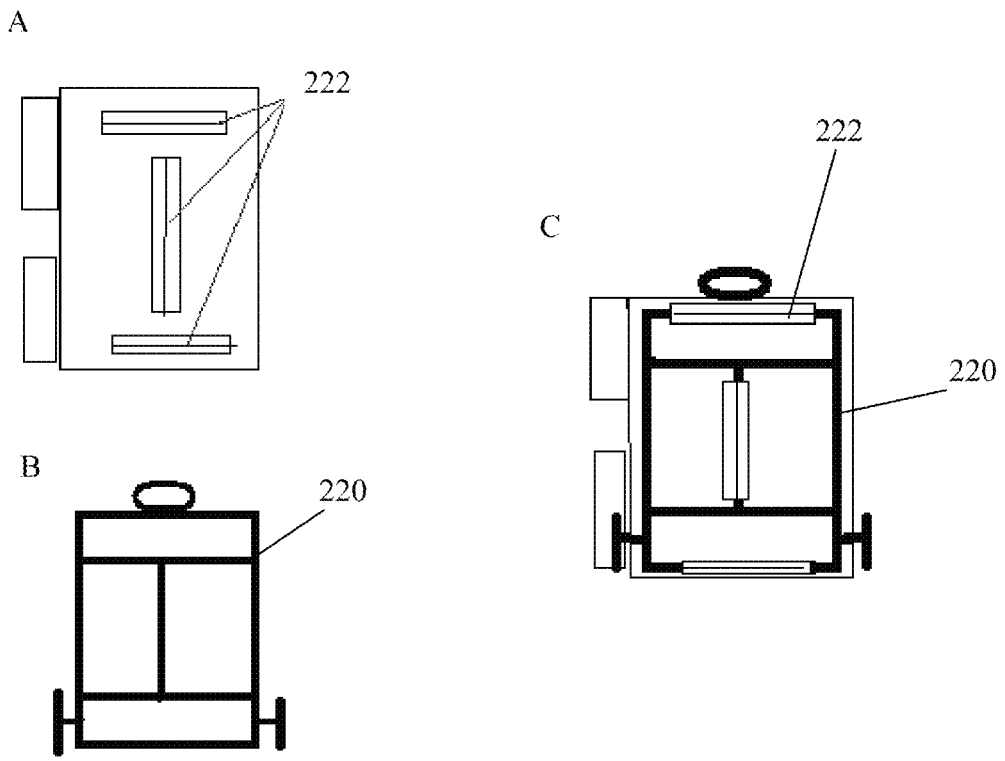
FIG. 23 shows an example ventilated bag configured to be detachably attachable to a carrier.

FIG. 22 shows an example variation of the ventilated bag of FIG. 20, where the bag includes a roller cart or roller carrier 220. The bag may be detachable from the carrier 220 or may be permanently affixed to the carrier 220. FIG. 23A shows an example where the bag is detachable from the carrier 220. In the example shown, the bag includes attachment mechanisms, in this example zippered flaps 222, for detachably attaching the bag to the carrier 220. In this example, the zippered flaps 222 are positioned at the top, bottom, and down the middle of the bag, although in other examples the zippered flaps 222 or other attachment mechanisms may be positioned differently to correspond to the structure of the carrier 220. FIG. 23B shows an example of the carrier 220 suitable for the bag of FIG. 23A, with the bag detached. FIG. 23C shows an example of the carrier 220 of FIG. 23B with the bag of FIG. 23A attached (back view). Where the bag is detachable from the carrier 220, the bag may be used independent of the carrier 220.

Typically, as in the examples shown in FIG. 20 and FIG. 21, the ventilated bag may be designed to be relatively compact and light weight, even with a non-detachable fan, allowing drying of bag contents without having to apply heat. That the fan is non-detachable may be useful to avoid the user accidentally losing or misplacing the fan. The presence of a protective shield for the fan may allow a non-detachable fan to be used while avoid potential damage to the fan from debris. The inclusion of air filters (e.g., carbon or charcoal filters) in the vents, for example in all air outlets and vents on the ventilated bag, may be useful for reducing or eliminating odor released from the bag.

The inclusion of separate ventilated pockets may be useful for drying particularly moist equipment, such as skates or footwear, while other equipment may be dried in the main container of the bag without requiring any special placement or order for drying. In contrast, conventional ventilated bags may require equipment in the bag to be placed in a particular configuration in order to effectively dry the equipment. This may require the use of charts or instruction manuals so the user will know the necessary placement of the equipment. This may be difficult, time-consuming and/or frustrating, particularly for young children or those in a hurry. The presently disclosed ventilated bag may overcome this problem. For example, the present ventilated bag may have larger compartments and pockets than conventional bags, which may better facilitate air flow through the bag without requiring any particular configuration of the equipment in the bag. The ventilated bag may have a volume larger than the volume of equipment to be stored therein. For example, while a conventional hockey bag for holding a full set of hockey equipment may measure about 16"×16"×36" or 38", the present ventilated bag, when designed to hold a full set of hockey equipment, may measure about 18"×18"×40", which provides about 30%-40% additional volume, thus facilitating an improved air flow through the bag. This may be equivalent to the bag having a volume of at least about 25%-50% larger than the equipment it is designed to hold. In some examples, the relative percentage increase in the size of the disclosed ventilated bag, as compared to the equipment it is designed to hold and as compared to a conventional bag, may be greater where there is more equipment to hold. For example, for a hockey bag or a lacrosse bag, designed to hold a full set of protective equipment and footwear for a single player, the disclosed ventilated bag may be 30%-40% larger than a conventional hockey bag or lacrosse bag, or 50% larger than the volume of the equipment; whereas for a shoe bag or a track bag, designed to hold only footwear or a smaller set of equipment, the disclosed ventilated bag may be 20% larger than a conventional shoe bag or track bag, or 25% larger than the volume of the equipment.

Further, in some examples, the disclosed ventilated bag may be configured to be at least partially inflatable when ventilating. That is, the ventilated bag may puff up to facilitate air flow through its contents when the fan is turned on, which may help to promote good air circulation around equipment contained in the bag and thus help with drying of the equipment. In some examples, the ventilated may be made of a material (e.g., lightweight, relatively impermeable to air) that allows the bag to be partially inflatable. In some examples, the fan is configured (e.g., strength and/or location) to provide partial inflation of the bag. In some examples, the air outlets are configured (e.g., number, size and/or location relative to the fan) to provide partial inflation of the bag.

Figure 24A:
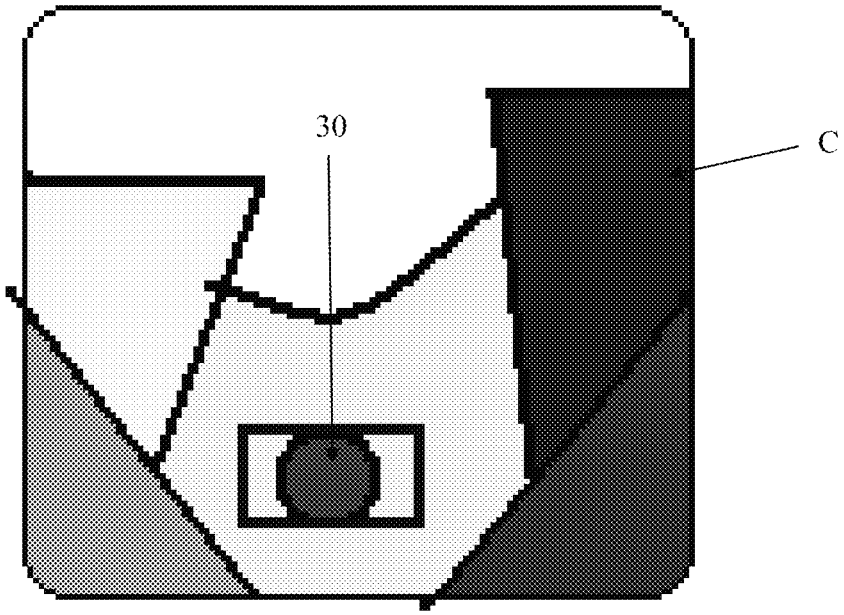
FIGS. 24A and 24B show an example of the ventilated bag with the fan off and with the fan off.
Figure 24B:
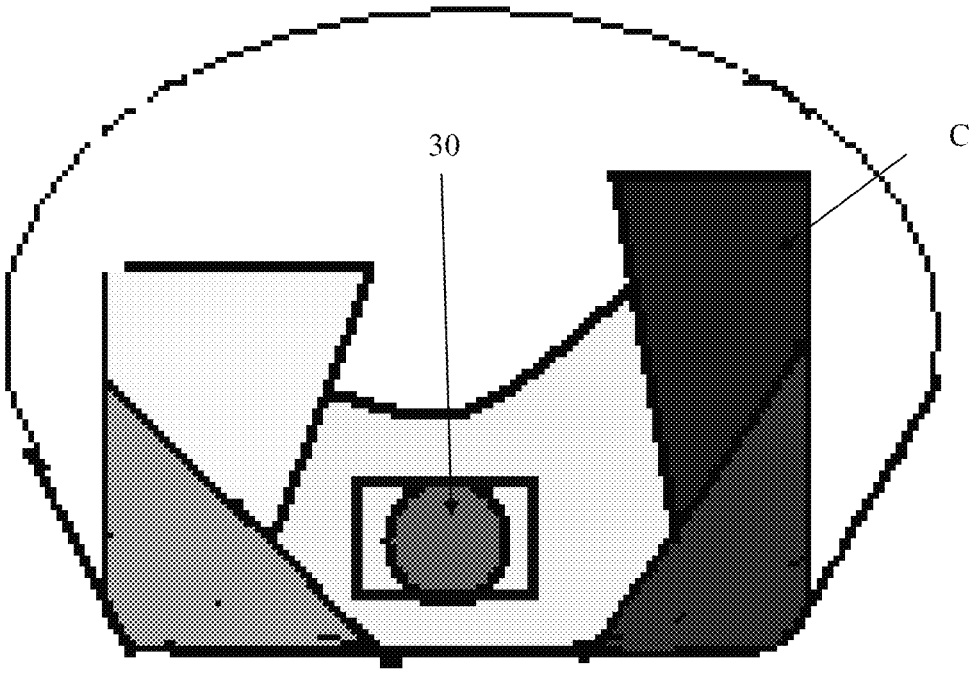

Reference is now made to FIGS. 24A and 24B. When full, the disclosed ventilated bag may contain all of its contents C. As seen in FIG. 24A, showing the bag containing contents C with the fan off, the contents may be placed in the bag in any manner. In FIG. 24B, when the fan is turned on, the walls of the bag may expand away from the contents (i.e., the bag may fully or partially inflate), allowing air to flow all around the contents, the contents being in the same position as when the fan is off. This expansion of the bag may create a relatively large volume for air to move around and through the contents, enabling quicker drying of the contents as compared to a conventional bag. Such inflation typically is not found in conventional bags. Conventional bags may bag made with materials that are too heavy or inflexible to provide such inflation, or may be too small to provide enough volume for air flow around its intended contents. Since the contents of the conventional bag remain stationary, conventional bags that do not inflate in the manner of the disclosed ventilated bag provide less air flow around bag contents.

Expansion of the disclosed ventilated bag when the fan is turned on may be facilitated by choosing material for the bag that allows at least partial inflation (e.g., a lightweight, relatively air-impermeable material). For example, a material having the properties of a 8400 denier polyester (or lighter) may be suitable. The configuration of vents and/or pockets on the bag may also be designed to facilitate at least partial inflation of the bag (e.g., by locating vents at a maximal distance from the fan). The bag may have a volume of at least about 25%-50% larger than the contents it is designed to hold, to help facilitate at least partial inflation of the bag.

In some examples, the disclosed ventilated bag may provide improved air flow over conventional ventilated bags. For example, the present ventilated bag may provide an air flow in the range of about 100 to about 150 cubic feet per minute (cfm), or about 170 to about 200 cfm, through the bag, which may be up to twice or more the air flow provided by conventional ventilated bags. In some examples, the disclosed ventilated bag may provide shortened drying time for equipment in the bag, which may be half the drying time or one third the drying time required using a conventional ventilated bag.

Thus, the presently disclosed ventilated bag may be useful for drying equipment without requiring the user to remove equipment from a carrying bag to dry out in an open space, which would be both troublesome and would risk accidental loss of equipment.

Modifications and improvements to the above-described example embodiments are included within the scope of the present disclosure. The foregoing description is intended to be exemplary rather than limiting. Features described in separate embodiments may be used in combination. All values and sub-ranges within disclosed ranges are also disclosed. All references mentioned are hereby incorporated by reference in their entirety.

The invention claimed is:

1. A ventilated portable equipment bag for storing, transporting and drying sports equipment, the bag comprising:

an inflatable structure for holding the sports equipment, the inflatable structure being defined by at least one wall;

an openable and closable closure feature having an open state, in which sports equipment can be inserted or retrieved, and a closed state, in which the feature cooperates with the inflatable structure to substantially fully enclose the sports equipment;

a ventilator mounted in a wall of the inflatable structure for drawing fresh air into the inflatable structure and for encouraging stale air from the inflatable structure to exhaust through at least one filtered air outlet located in a wall of the inflatable structure, the at least one filtered air outlet having a carbon air filter; and an openable and closable exterior pocket on an exterior side of the inflatable structure for storing at least one article of sports equipment, the exterior pocket having at least one air inlet for receiving the fresh air from the ventilator and at least one filtered air vent for exhausting stale air from the exterior pocket, the at least one filtered air vent having a carbon air filter; and wherein the structure defines a volume at least 25% larger than the volume of equipment to be stored therein, the inflatable structure configured to at least partially inflate in the closed state upon actuation of the ventilator.

2. The ventilated portable equipment bag of claim 1, wherein the ventilator provides airflow through the structure and any equipment stored therein of about 100 to about 200 cubic feet per minute (cfm).

3. The ventilated portable equipment bag of claim 1 wherein the structure defines a volume 25-50% larger than the volume of equipment to be held within the structure.

4. The ventilated portable equipment bag of claim 1 wherein the container is for holding hockey equipment including a pair of skates and a complete set of protective gear suitable for one hockey player, and the container is 30%-50% larger than the volume of the equipment.

5. The ventilated portable equipment bag of claim 1 wherein the container is for holding lacrosse equipment including footwear and a complete set of protective gear suitable for one lacrosse player, and the container is 30%-50% larger than the volume of the equipment.

6. The ventilated portable equipment bag of claim 1 further comprising a plurality of filtered air outlets, and at least one filtered air outlet is provided in each of: a bottom wall of the structure, in side walls of the structure and in a back wall of the structure, the filtered air outlets having filters capable of purifying the air exhausting from the structure.

7. The ventilated portable equipment bag of claim 1 wherein the structure further comprises inside mesh pockets for storing sports equipment on opposed side portions of the structure.

8. The ventilated portable equipment bag of claim 1 wherein the ventilator is detachable.

9. The ventilated portable equipment bag of claim 1 wherein the at least one air inlet of the exterior pocket is in fluid communication with an interior of the structure for receiving air from inside the structure, and the at least one air vent of the exterior pocket vents air outside of the container.

10. The ventilated portable equipment bag of claim 1 comprising a plurality of structures, the plurality of structures being separated by partitions, wherein the partitions include a mesh portion for fluid communication among the plurality of structures.

11. The ventilated portable equipment bag of claim 1 wherein the container is detachably attachable to a carrier.

12. The ventilated portable equipment bag of claim 1 further comprising a protective shield attachable to sides of the ventilator for protecting the ventilator from debris.

13. The ventilated portable equipment bag of claim 1 wherein the at least one air vent of the exterior pocket comprises an air filter for purifying air exhausted from the at least one air vent.

14. The ventilated portable equipment bag of claim 1 further comprising a power source or a power cable for receiving power from a power source.

15. The ventilated portable equipment bag of claim 1 wherein the inflatable structure comprises a ventilated compartment having at least one footwear attachment for detachably receiving footwear.

16. The ventilated portable equipment bag of claim 15 further comprising an additional ventilated compartment for storing and drying an article of clothing.

17. The ventilated equipment bag of claim 15 further comprising a plurality of filtered air outlets disposed on at least two different panels of the bag.

18. The ventilated portable equipment bag of claim 1 wherein the ventilator is non-detachable.

19. The ventilated portable equipment bag of claim 1 wherein the inflatable structure is formed of at least partially air-impermeable material.

20. The ventilated portable equipment bag of claim 1 wherein each of the at least one filtered air outlet is located in a respective wall of the inflatable structure to provide at least partial inflation of the inflatable structure upon actuation of the ventilator.

21. The ventilated portable equipment bag of claim 1 wherein at least one filtered air outlet is formed in the respective at least one wall that is a maximal distance from the ventilator.

* * * * *